US006796034B2

(12) United States Patent
Loser

(10) Patent No.: US 6,796,034 B2
(45) Date of Patent: Sep. 28, 2004

(54) INTERCHANGEABLE HEAD CARVING TOOL

(76) Inventor: Mark A. Loser, W-4904 Town Hall Rd., Peshtigo, WI (US) 54157-9583

( * ) Notice: Subject to any disclaimer, the term of this patent is extended or adjusted under 35 U.S.C. 154(b) by 69 days.

(21) Appl. No.: 10/107,114

(22) Filed: Mar. 28, 2002

(65) Prior Publication Data

US 2003/0056373 A1 Mar. 27, 2003

Related U.S. Application Data

(60) Provisional application No. 60/324,107, filed on Sep. 21, 2001.

(51) Int. Cl.[7] ..... B26B 3/00

(52) U.S. Cl. ..... 30/168; 30/167; 30/301; 30/316

(58) Field of Search ..... 30/168, 477, 485, 30/113.8, 340, 344, 315, 314, 316, 329, 277, 347, 422, 164.5, 167, 301, 169; 125/6; 81/20, 25; 425/279, 221, 276, 187, 281; 37/411; 83/886; 144/67, 68, 78, 79

(56) References Cited

U.S. PATENT DOCUMENTS

| | | | | | |
|---|---|---|---|---|---|
| 788,217 | A | * | 4/1905 | Mohr | 30/301 |
| 974,021 | A | * | 10/1910 | Blake | 81/25 |
| 1,126,134 | A | * | 1/1915 | Van Bochove | 30/142 |
| 1,243,504 | A | * | 10/1917 | Furber | 30/167 |
| 1,323,523 | A | * | 12/1919 | Cox | 425/144 |
| 1,501,095 | A | * | 7/1924 | Brock | 81/19 |
| 1,537,057 | A | * | 5/1925 | Annesley | 29/81.16 |
| 1,557,464 | A | * | 10/1925 | Mick | 408/205 |
| 2,114,703 | A | * | 4/1938 | Conner | 294/55 |
| 2,557,191 | A | * | 6/1951 | King | 30/316 |
| 3,004,340 | A | * | 10/1961 | Collins | 30/316 |
| 5,216,939 | A | | 6/1993 | Swenson | |
| 6,347,562 | B1 | * | 2/2002 | Gerber, Jr. | 81/25 |

FOREIGN PATENT DOCUMENTS

| | | |
|---|---|---|
| GB | 1050397 | * 12/1966 |

* cited by examiner

*Primary Examiner*—Hwei-Siu Payer
(74) *Attorney, Agent, or Firm*—Wilhelm Law Service; Thomas D. Wilhelm

(57) ABSTRACT

A carving tool in which a concave hemispherical cutting head is detachably secured to a base member and a handle by fastener structure, thus securing the cutting head, the base member, and the handle to each other. The carving tool is a swinging impact tool which is used in a manner similar to conventional swinging of an ax or hammer, and thus utilizes the kinetic energy of the swing of the head, applied to materials being worked, at a cutting edge, to perform carving and cutting operations.

32 Claims, 2 Drawing Sheets

INTERCHANGEABLE HEAD CARVING TOOL

CROSS REFERENCE TO RELATED APPLICATIONS

The application claims the benefit of U.S. Provisional Patent Application Ser. No. 60/324,107 filed Sep. 21, 2001.

BACKGROUND OF THE INVENTION

The object of my present invention involves novel improvements in carving and cutting, tools which greatly increase material removal rates, ease difficult contouring operations, extend tool cutting edge life and allow simplified sharpening of the tool cutting edge by anyone with average skills, these properties being heretofore inadequate.

Conventional carving and cutting tools require the brute force of the operator to push and guide tools through materials, thereby minimizing material removal rates and straining the operator. Conventional carving and cutting tools tend to dull often due to their minimal cutting edge length. Conventional carving and cutting tools have difficulty in producing pockets, cavities and depressions with rounded corners. Conventional carving and cutting tools tend to jam or get stuck in materials due to their cutting edge geometry. Another drawback of conventional carving and cutting tools relates to the difficulty in restoring the cutting edge to an adequate sharpness, which can require expensive equipment and which restoration is difficult and frustrating.

SUMMARY OF THE INVENTION

To an understanding of the nature of my invention and its basic distinctions from the carving and cutting tools of common use, it is necessary to explain some principles and properties upon which my tool is designed.

My invention utililizes the concept of kinetic energy, whereby the mass of the tool in motion effects a great material removal rate compared to conventional carving and cutting tools, and imposes minimal strain on the operator. In simple terms, an ax or hammer type swing is used to impact the material being worked.

By having a choice of many various diameters and weights of interchangeable cutting heads, an operator can attain a wide range of material removal rates, and can also create many different contours with corner radii equal to radius of the selected cutting head.

My tool incorporates a cutting head having a convex outside shape which acts as a depth control device, thereby guiding the cutting edge into, through, and out of the material being cut, during the cutting process, which reduces jamming of the tool in the material being worked.

My tool has a concave hemispherical cutting head which allows the use of 360 degrees of the cutting head edge, thereby extending cutting edge life and providing unique opportunities such as producing pockets, depressions and cavities with rounded corners.

The inside of the cutting head, which is a concave hemispherical shape, provides a 180 degree arc contour for chips to follow during cutting, thereby expelling chips efficiently from the interior of the cutting head.

By pushing or pulling the tool across the material being cut, using a scraping motion, one can produce various groove contours while also achieving good material removal rates.

Another advantage of my invention is a very simple means of restoring the cutting edge sharpness by utilizing an appropriate arbor to mount the cutting head to a drill motor, then rotating the cutting head while bringing the cutting edge of the cutting head into contact with abrasive cloth or paper tangent to the inner and outer cutting edge faces, thereby restoring the cutting edge to an adequate sharpness.

DETAILED DESCRIPTION OF THE ILLUSTRATED EMBODIMENTS

Figure 1:
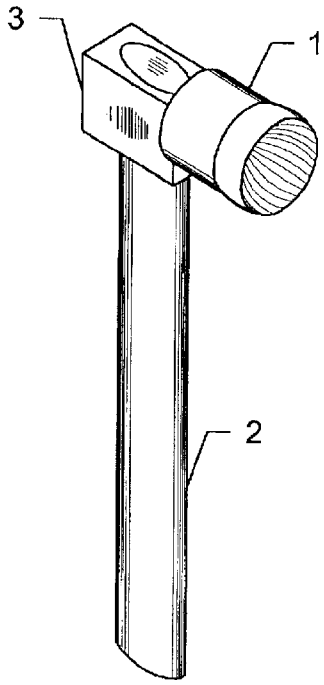
FIG. 1 is a perspective view of the Interchangeable Head Carving Tool.
Figure 3:
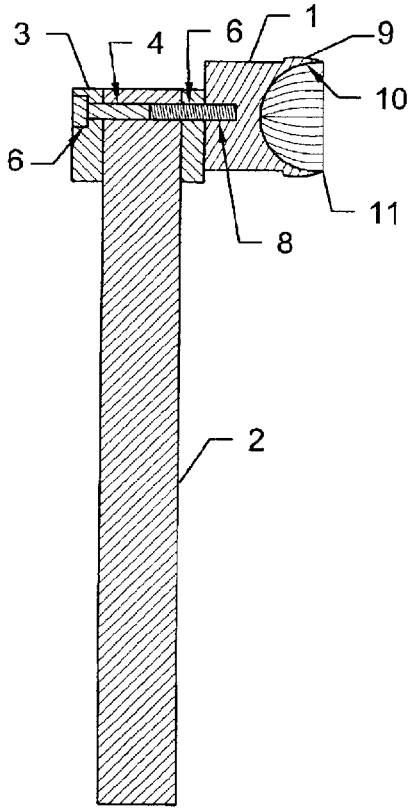
FIG. 3 is a fragmentary elevation cross section view of the Interchangeable Head Carving Tool.

The tool as shown in FIGS. 1 and 3 is comprised of a base member 3, a handle 2, an interchangeable cutting head 1, and a screw 4.

The base member 3, is machined from a metal billet, forged from metal, or cast from metal, and has an oval hole 5 extending therethrough for insertion of a handle. A counterbored screw hole 6 is drilled through base member 3 perpendicular to oval hole 5, and a lateral hole 7 is drilled through handle 2 to align with the counterbored screw hole 6. Screw 4 passes through counterbored screw hole 6, then through said lateral hole 7, then threadably engages female threads 8 of cutting head 1, thereby securing base member 3, handle 2 and cutting head 1 positively together to each other as the Interchangeable Head Carving Tool.

Figure 4:
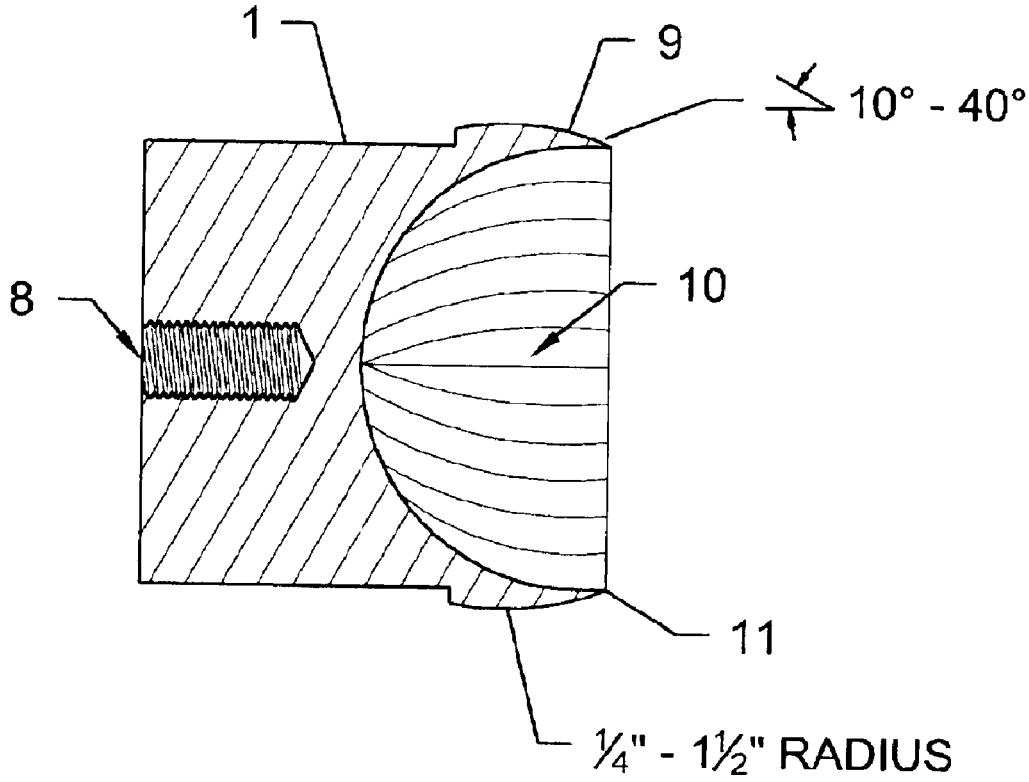
FIG. 4 is an elevation cross section view of the cutting head.
Figure 5:
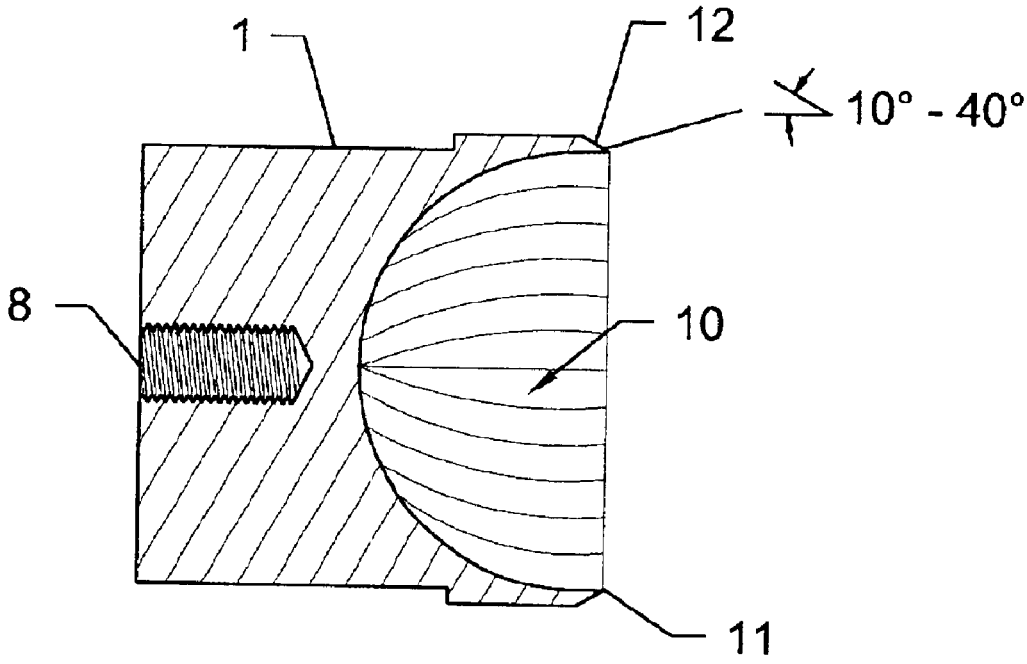
FIG. 5 is an elevation cross section view of a cutting head with a beveled outside contour.

Cutting head 1 is machined from a solid cylinder of metal, or a forging. During the machining process, a bore is created extending from the base end of base member 3 toward the working end, and female threads 8 are tapped concentrically into the body of cutting head 1 at the bore as shown in FIGS. 4 and 5. A convex outside surface 9 is produced as shown in FIGS. 3 and 4, having an outside contour ranging between ¼ inch and 1½ inches radius, and beginning at the cutting edge 11 at an angle of between 10 degrees and 40 degrees away from the longitudinal axis of the cutting head 1, which longitudinal axis is co-axial with threads 8 in the mounting aperture. Stated another way, the outside surface and the inside surface meet at the cutting edge at an angle of between 10 and 40 degrees. The convex outside surface extends initially outwardly of the longitudinal axis to a maximum cross-section width of the cutting head, which maximum cross-section width is displaced from the cutting edge, and thence toward the base end of the cutting head, while the inside surface extends initially generally parallel to the longitudinal axis. The outside surface extends to the base end where the base end interfaces with base member 3. The inside surface is a concave hemispherical surface 10 and is the inside working surface of the cutting head, as shown in FIGS. 3 and 4.

As shown in FIGS. 3–5. the inside surface 10 is a generally continuous surface such that the cavity defined by the inside surface has no secondary material outlet whereby material, such as wood chips, which is cut by the cutting edge, can leave the cavity. Namely, the opening defined by the cutting edge is the only exit path whereby material, which is cut at cutting edge 11, can exit the cavity.

A 360 degree sharp cutting edge 11 is located where the convex outside surface 9 and the concave hemispherical inside surface 10 meet tangentially as shown in FIGS. 3 and 4. Cutting head 1 is then heat treated and tempered to an adequate hardness, thereby providing a strong cutting edge with good wear resistance.

Figure 2:
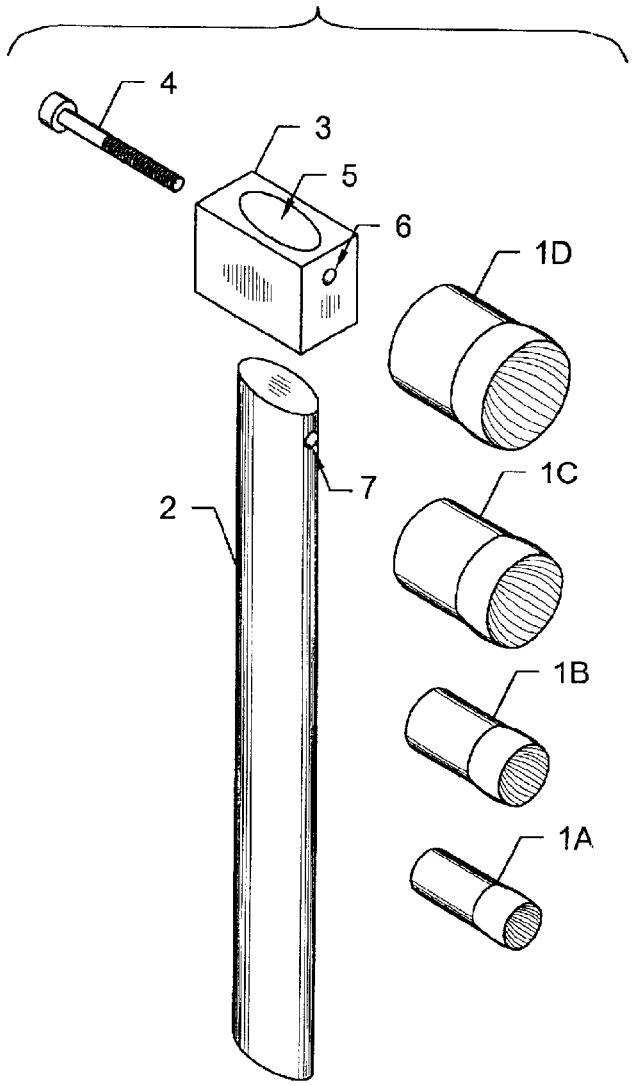
FIG. 2 is a fragmentary exploded perspective view of the tool system and showing four interchangeable cutting heads, (1*a*, 1*b*, 1*c* and 1*d*), of various diameters and weights.

The tool system shown in FIG. 2 shows interchangeable cutting heads of four various diameters and weights, (1*a*, 1*b*, 1*c* and 1*d*), of which a multiplicity of diameters and weights is possible.

FIG. 5 shows a cutting head variation having a beveled outside surface 12, which is initiated at the cutting edge 11, and which connects, through an intermediate surface, to the base end. Beveling the outside surface simplifies the manufacturing process, but reduces the performance of the cutting head 1.

The Interchangeable Head Carving Tool of FIG. 1 is used to carve, cut, or remove materials including, but not limited to, wood, ice, or plastics. The user simply chooses which diameter cutting head, (1*a*, 1*b*, 1*c*, or 1*d*) as shown in FIG. 2, is appropriate for a particular job, and attaches the chosen cutting head to base member 3 by means of screw 4. By using a swinging motion, such as is commonly used with an ax or hammer, the user repeatedly strikes the material being carved incrementally deeper with each successive swing until the user's objective is met.

By pushing or pulling the Interchangeable Head Carving Tool of FIG. 1 in a scraping motion across a material, many unique grooves can be produced, and good material removal rates can be achieved.

While certain representative embodiments and details have been shown for the purpose of illustrating the invention, it will be apparent to those skilled in the art that various changes in form and detail may be made without departing from the spirit and scope of the invention as defined by the appended claims.

What I claim is:

1. A carving tool, comprising:

a base member having a first hole extending therethrough and adapted to receive a handle, a second hole extending through said base member and aligned across the first hole, and adapted to receive a fastener, and a surface parallel to an axis of the first hole and transverse to an axis of said second hole;

a cutting head having a base end and a working end, said working end having an outside surface, said outside surface beginning at a cutting edge, at an angle of between 10 and 40 degrees from a direction parallel to a longitudinal axis of said cutting head, and extending toward the base end, said working end further having a concave inside surface, extending from the cutting edge, where the concave inside surface meets the outside surface;

an elongate handle received in the first hole; and a fastener detachably securing said cutting head to said base member, and securing said base member to said handle.

2. A carving tool as in claim 1, said handle having a lateral hole extending therethrough in a position aligned with said second hole in said base member.

3. A carving tool as in claim 1 wherein said fastener passes through said handle and into said base member.

4. A carving tool as in claim 1, said working end of said cutting head having a 360 degree cutting edge.

5. A carving tool as in claim 1, further comprising a bore extending from said base end toward said working end, and comprising female threads therein.

6. A carving tool as in claim 1, the outside surface having a radius between ¼ inch and 1½ inches.

7. A carving tool as in claim 1 wherein said fastener passes through said handle and into said base member.

8. A cutting head having a base end and a working end, said working end having an outside surface, said outside surface beginning at a sharp cutting edge which is effective for cutting or carving wood, and extending from the sharp cutting edge at an angle of between 10 and 40 degrees measured with respect to a longitudinal axis of said cutting head, and away from the longitudinal axis to a maximum cross-section width, which maximum cross-section width is displaced from the cutting edge, and extending toward the base end, said working end further having a concave inside surface, extending from the cutting edge where the concave inside surface meets the outside surface, the concave inside surface defining a cavity inside said cutting head.

9. A cutting head as in claim 8, said working end of said cutting head having a 360 degree cutting edge.

10. A cutting head as in claim 8, further comprising a bore extending from said base end toward said working end, and comprising female threads therein.

11. A cutting head as in claim 8, the outside surface having a radius between ¼ inch and 1½ inches.

12. A cutting head as in claim 8 wherein the concave inside surface is a generally continuous surface such that the cavity has no secondary material outlet whereby material which is cut by the cutting edge could leave the cavity.

13. A carving tool, comprising:

a base member having a first hole extending therethrough and adapted to receive a handle, a second hole extending through said base member and aligned across the first hole, and adapted to receive a fastener, and a surface parallel to an axis of the first hole, and transverse to an axis of said second hole;

a cutting head having a base end and a working end, said working end having a beveled outside surface, said beveled outside surface extending from a cutting edge at an angle of between 10 and 40 degrees from a direction parallel to a longitudinal axis of said cutting head, and extending toward said base end, said working end further having a concave inside surface, beginning at the cutting edge where the concave inside surface meets the beveled outside surface, the concave inside surface defining a cavity inside said cutting head;

an elongate handle received in the first hole; and fastener structure detachably securing said cutting head to said base member, and securing said base member to said handle.

14. A carving tool as in claim 13, said handle having a lateral hole extending therethrough in a position aligned with said second hole in said base member.

15. A carving tool as in claim 13, said working end of said cutting head having a 360 degree cutting edge.

16. A carving tool as in claim 13 wherein said cutting head comprises a bore comprising female threads (8) therein, and wherein said fastener structure comprises a screw (4) passing through said handle and into said bore.

17. A cutting head having a base end and a working end, said working end having a beveled outside surface, said beveled outside surface beginning at a cutting edge and extending away from the cutting edge at an angle of between 10 and 40 degrees measured with respect to a longitudinal axis of said cutting head, and away from the longitudinal axis to a maximum cross-section width, which maximum cross-section width is displaced from the cutting edge, and extending toward said base end, said working end further having a concave inside surface, extending from the cutting edge, where the concave inside surface meets the beveled outside surface, the concave inside surface defining a cavity inside said cutting head.

18. A cutting head as in claim 17, said working end of said cutting head having a 360 degree cutting edge.

19. A cutting head as in claim 17, further comprising a bore extending from said base end toward said working end, and comprising female threads (8) therein.

20. A cutting head as in claim 17 wherein the concave inside surface is a generally continuous surface such that the cavity has no secondary material outlet whereby material which is cut by the cutting edge could leave the cavity.

21. A cutting head having a base end and a working end, said working end having a sharp cutting edge which is effective for cutting or carving wood, and having an a outside surface and a concave inside surface, both the outside surface and the concave inside surface extending from the cutting edge, the outside surface extending outwardly from the share cutting edge and away from the longitudinal axis to a maximum cross-section width, which maximum cross-section width is displaced from the cutting edge, the inside surface defining a cavity in said cutting head.

22. A cutting head as in claim 21, an included angle, between the outside surface and a line parallel to a longitudinal axis of said cutting head, beginning at a magnitude of between 10 and 40 degrees at said cutting edge and extending away from the longitudinal axis.

23. A carving tool comprising a cutting head as in claim 22, and an elongate handle mounted to said cutting head.

24. A cutting head as in claim 21, said working end having a 360 degree cutting edge.

25. A carving tool comprising a cutting head as in claim 24, and an elongate handle mounted to said cutting head.

26. A carving tool comprising a cutting head as in claim 21, and an elongate handle mounted to said cutting head.

27. A cutting head as in claim 21 wherein the concave inside surface is a generally continuous surface such that the cavity has no secondary material outlet whereby material which is cut by the cutting edge could leave the cavity.

28. A cutting head having a base end and a working end, said working end having a sharp cutting edge defined by an inside surface and an outside outer surface, said outside surface being defined at least in part by an included angle of between 10 and 40 degrees, measured at said cutting edge, with respect to a longitudinal axis of said cutting head, while the inside surface extends initially generally parallel to the longitudinal axis and defines a cavity in said cutting head.

29. A cutting head as in claim 28 wherein said outside surface comprises a convex outside surface as defined at a cross-section along the longitudinal axis.

30. A carving tool comprising a cutting head as in claim 29, and an elongate handle mounted to said cutting head.

31. A carving tool comprising a cutting head as in claim 28, and an elongate handle mounted to said cutting head.

32. A cutting head as in claim 28 wherein the inside surface is a generally continuous surface such that the cavity has no secondary material outlet whereby material which is cut by the cutting edge could leave the cavity.

* * * * *